US006332331B1

(12) United States Patent
Cheng et al.

(10) Patent No.: US 6,332,331 B1
(45) Date of Patent: Dec. 25, 2001

(54) WATER REMOVAL ENHANCEMENT DEVICE FOR REFRIGERATION SYSTEM

(75) Inventors: Wei-Yueh Cheng; Shih-Pei Lin, both of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/721,940

(22) Filed: Nov. 27, 2000

(51) Int. Cl.[7] ..... F25D 21/06

(52) U.S. Cl. ..... 62/275; 62/282; 62/285; 62/272; 62/3.1

(58) Field of Search ..... 62/282, 285, 272, 62/3.1, 275

(56) References Cited

U.S. PATENT DOCUMENTS 5,149,446 * 9/1992 Reidy ..... 210/744
5,161,739 * 11/1992 Saito et al. ..... 237/9 R
5,201,192 * 4/1993 Hara ..... 62/285
5,456,596 * 10/1995 Gourdine ..... 431/9
6,036,827 * 3/2000 Andrews et al. ..... 204/252

* cited by examiner

*Primary Examiner*—William Doerrler
*Assistant Examiner*—Mark Shulman
(74) *Attorney, Agent, or Firm*—Birch, Stewart, Kolasch & Birch, LLP

(57) ABSTRACT

A water removal enhancement device applicable to an evaporator of a refrigeration system includes a pulse power supply, an electrode mounted under the evaporator, and metallic needles formed on the bottom of the evaporator. The needles of the evaporator and the electrode are electrically connected to the power of the pulse power supply, so that negative (or positive) electricity is charged to the evaporator and the needles, while the positive (or negative) power of the pulse power supply is charged to the electrode. The condensed water formed on the evaporator and falling to the needles is therefore easily attracted by the electrode via electric discharge effect on tip points and easily drop from the evaporator to the electrode and drain away.

20 Claims, 3 Drawing Sheets

WATER REMOVAL ENHANCEMENT DEVICE FOR REFRIGERATION SYSTEM

BACKGROUND OF THE INVENTION

1. Field of Invention

The present invention generally relates to a refrigeration system of air conditioners and dehumidifiers, and more particularly relates to a refrigeration system, in which an enhancement device for removing condensation water from the evaporator is incorporated.

2. Related Art

As shown in FIG. 1, a refrigeration system, such as air conditioner or dehumidifier, generally includes a refrigerant compressor, a condenser, an expansion valve or capillary, and an evaporator to be composed of a refrigeration cycle. Liquid state refrigerant in low pressure and low temperature is compressed by the compressor into high pressure and high temperature gas state refrigerant, then cooled down through the condenser to be high pressure and medium temperature liquid refrigerant. The refrigerant further passes through the expansion valve or capillary to decrease its pressure into low pressure and medium temperature liquid refrigerant, then passes through the evaporator to dissipate its heat into low pressure and low temperature liquid refrigerant, and recycles to the compressor.

The common evaporator of an air conditioner or a dehumidifier is a fin-type heat exchanger. Such a heat-exchanger includes a plurality of flat fins arranged in parallel at a predetermined interval allowing air to flow through for heat transfer, and a plurality of heat transfer tubes perpendicularly inserted to the plurality of flat fins to which the temperature of refrigerant is transferred while being flown inwards, and at the same time, being contacted to air for heat-exchange. In tubes of the evaporator, the refrigerant expands to lose its temperature so as to cool down the air passing through the gaps between the fins. Water vapor contained in the air is then condensed into water, formed on the fins, drip by its weight and drain away.

But, the removal of water by its weight is rather slow because it takes a long time for the dripping formed on the fin to be heavy enough for falling. Therefore, the water staying on the fins decrease the heat-exchanging area, occupy gaps between the fins and retard the airflow. The less heat-exchanging area and the lower airflow rate increase burden of the cooling fan, lower the heat-exchanging rate and lower the operation performance of the whole system.

In this field, an eletrohydradynamic effect had been applied for improving heat-exchanging rate, which also improves the efficiency of water removal. An eletrohydradynamic device utilizes a low electrically conductive liquid flowing between two electrodes to provide an electric field of high voltage and low current. The electric field excites the surfaces of heat transfer to increase the efficiency. The common low electrically conductive liquid is chosen from CFC or other refrigerants. The factors that influencing the efficiency of heat transfer are electrical parameters (such as voltage, shape of and distance between the electrodes and direction of the electrical field), fluidic parameters (such as flow rate and thermophysical characteristics of the fluid) and the conditions of the heat transfer surface (such as surface structure, shape and size of the tube), etc.

A water removal enhancement device utilizing eletrohydradynamic effect is disclosed. As shown in FIG. 2, the device applicable to evaporator of an air-conditioning system includes a pulse power supply and an electrode mounted under the evaporator. The pulse power supply includes a flyback transformer and corresponding circuits for generating a high voltage and low current power supplied to the electrode and the evaporator. Negative electricity is thereby generated on the evaporator, and positive electricity on the electrode. The electrode is a metal wire or other similar metallic element located under the evaporator. Since water is a high dielectric constant material, the condensed water formed on the evaporator is charged with negative electricity by the evaporator. Therefore, the negative electrified condensed water is attracted the positive electrode and easily drop from the evaporator to the electrode and drain away. This device improves the water removal from the evaporator and improves the heat transfer efficiency of the air-conditioning system. But, the water removal is still unsatisfactory and a better device is demanded.

SUMMARY OF THE INVENTION

It is therefore an object of the present invention to provide a water removal device for an air-conditioning system, which improves the heat transfer performance of the evaporator, increase the operational efficiency of the refrigeration system, and save energy consumption of the air-conditioning or dehumidification system.

To achieve the aforesaid object, a water removal enhancement device applicable to an evaporator of a refrigeration system includes a pulse power supply, an electrode mounted under the evaporator, and needles formed on the bottom of the evaporator. The electrode keeps a suitable gap with the needles. The needles are made of metallic material and electrically connected to the evaporator and the negative power of the pulse power supply, so that negative electricity is generated on the evaporator and the needles. The positive power of the pulse power supply is connected to the electrode. The condensed water formed on the evaporator and falling to the needles is therefore charged with negative electricity, which is easily attracted by the positive electrode via electric discharge effect on tip points and easily drop from the evaporator to the electrode and drain away.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
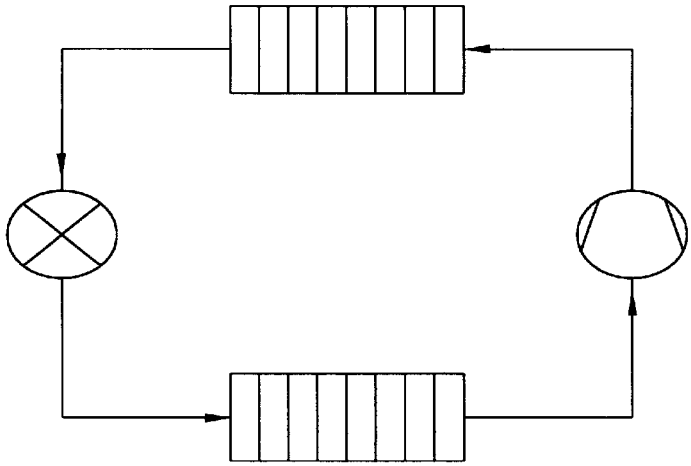
FIG. 1 (PRIOR ART)
FIG. 1 is a descriptive illustration of a common refrigeration system.
Figure 2:
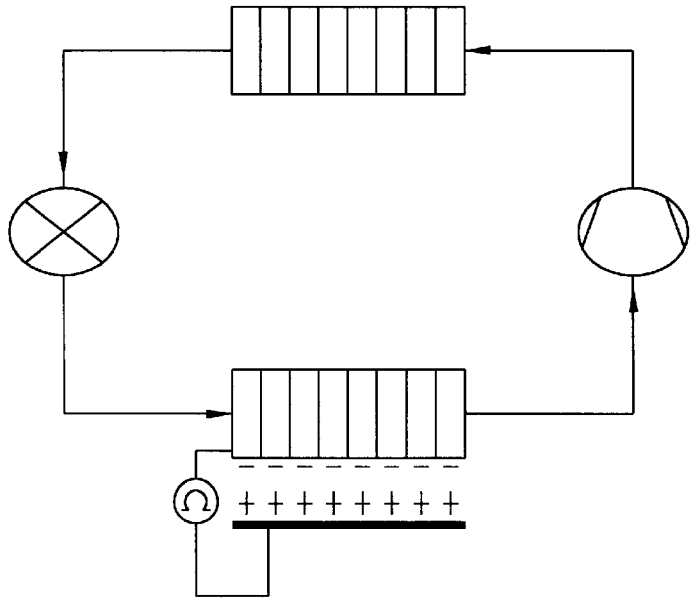
FIG. 2 (PRIOR ART)
FIG. 2 is a prior art water removal device applicable to a refrigeration system.
Figure 3:
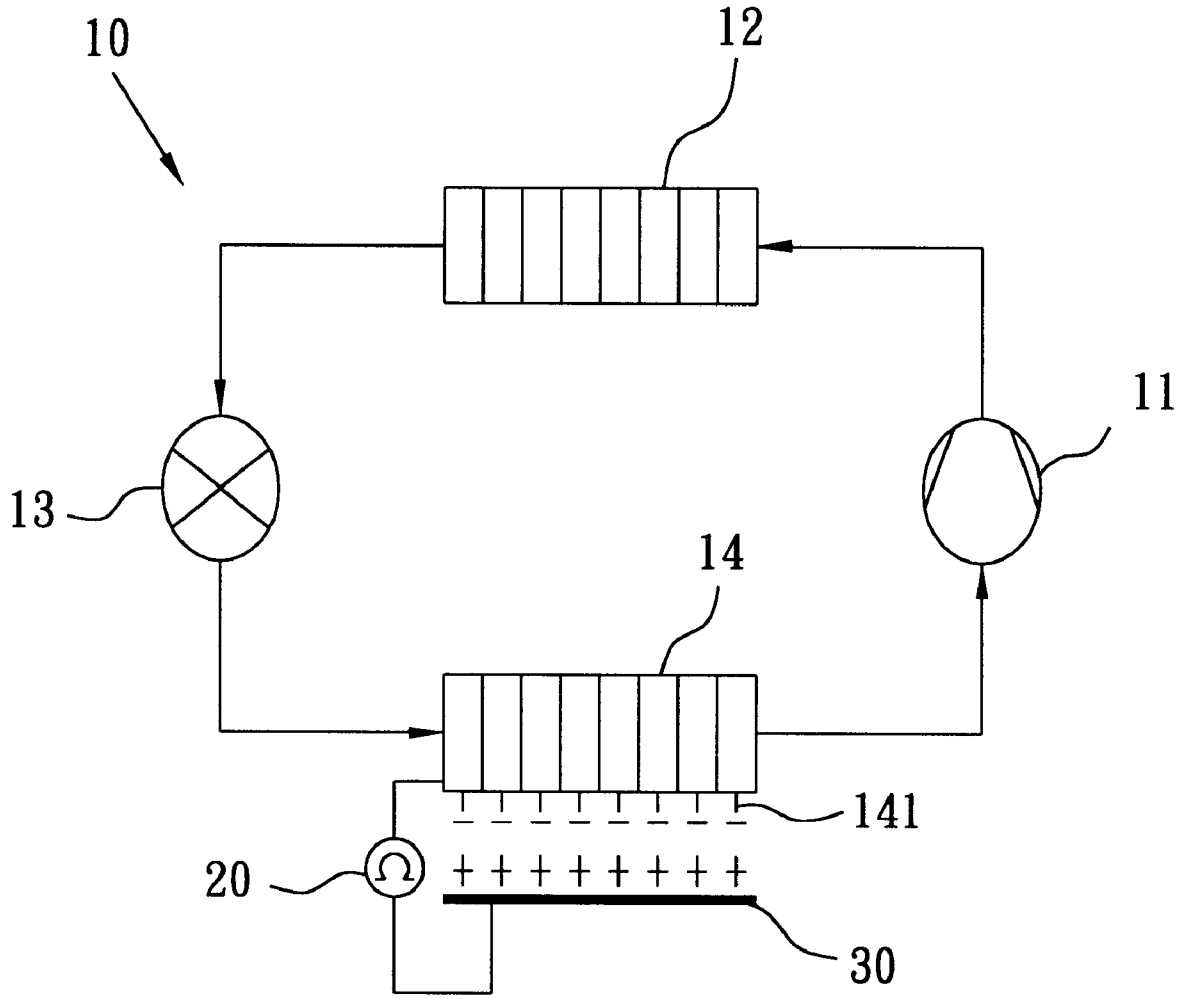
FIG. 3 is a constructional view of a water removal enhancement device of the present invention with needles charged with negative electricity.

FIG. 3 shows the composition of a water removal enhancement device according to the present invention. The device is applicable to an evaporator of a refrigeration system 10, such as an air-conditioner or a dehumidifier, which is composed of a compressor 11, a condenser 12, an expansion valve 13 and an evaporator 14. Liquid state refrigerant in low pressure and low temperature is compressed by the compressor 11 into high pressure and high temperature gas state refrigerant, then cooled down through the condenser to be high pressure and medium temperature liquid refrigerant. The refrigerant further passes through the expansion valve 13 to decrease its pressure into low pressure and medium temperature liquid refrigerant, then passes through the evaporator 14 to dissipate its heat into low pressure and low temperature liquid refrigerant, and recycles to the compressor 11. The refrigeration cycle cools down the evaporator 14 so that water vapor contained in the air is condensed into water and formed on the surface of the evaporator 14. The water removal enhancement device of the present invention includes a pulse power supply 20, an electrode 30 mounted under the evaporator 14, and needles 141 formed on the bottom of the evaporator 14.

The pulse power supply is composed of a flyback transformer and correspondent circuits for providing a high voltage and low current power. The needles 141 are made of metallic material and electrically connected to the evaporator 14 and the negative power of the pulse power supply 20, so that negative electricity is generated on the evaporator 14 and the needles 141. The electrode 30 is made of metallic wire, rod, plate or other electrically conductive materials. The positive power of the pulse power supply 20 is connected to the electrode 30 so as to be charged with positive electricity. Since the condensed water formed on the evaporator 14 and falling to the needles 141 is charged with negative electricity, it is easily attracted by the positive electrode 30 via electric discharge effect on tip points of the needles 141 and easily drop from the evaporator 14 to the electrode 30 and drain away. Because the condensed water being easily removed, the evaporator 14 is free from water hindering the airflow passages of the evaporator 14 so as to assure the airflow rate, lower the load of the fan, improve the heat transfer performance of the evaporator, and improve the operational efficiency of the system.

Figure 4:
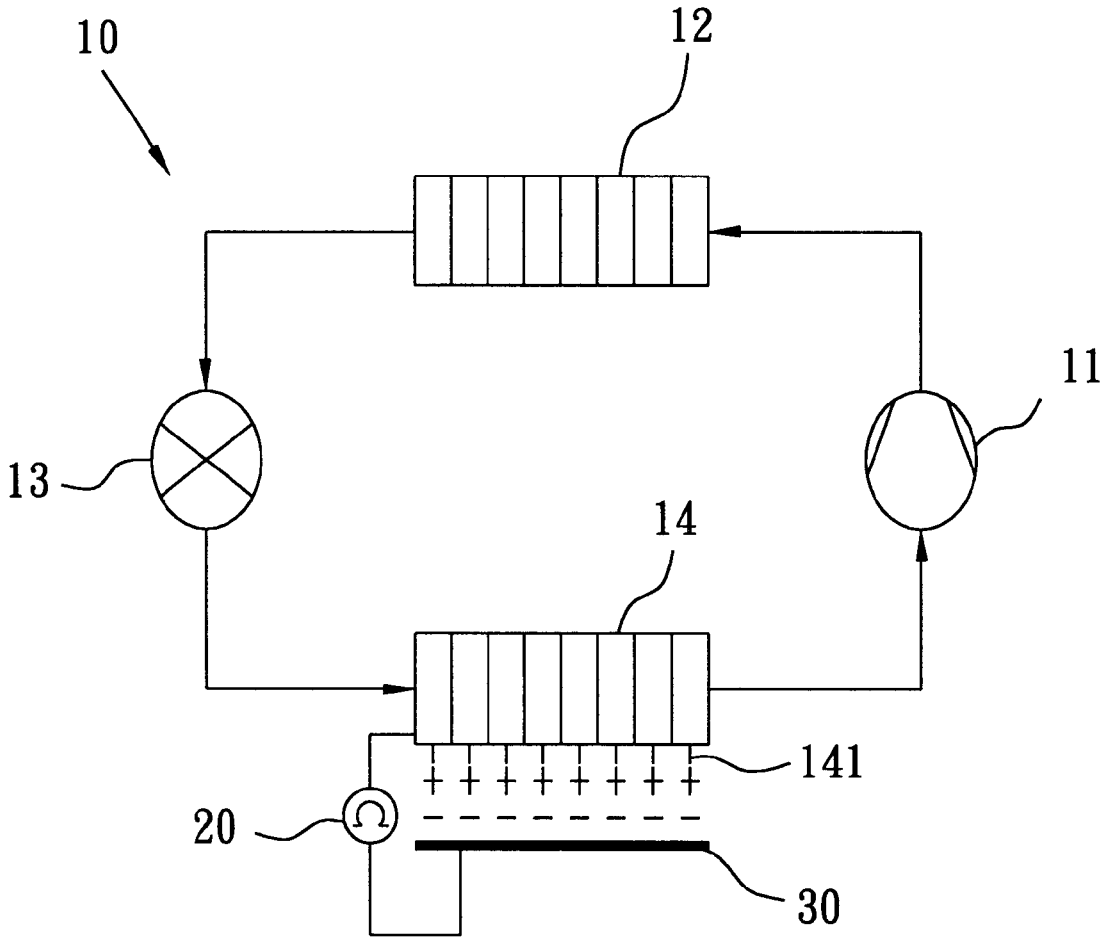
FIG. 4 is a constructional view of a water removal enhancement device of the present invention with needles charged with positive electricity.

In other way, as shown in FIG. 4, the needles 141 and the evaporator 14 are connected to the positive power of the pulse power supply 20, so that positive electricity is generated on the evaporator 14 and the needles 141. The electrode 30 is connected to the negative power of the pulse power supply so as to be charged with negative electricity. Since the condensed water formed on the evaporator 14 and falling to the needles 141 is charged with positive electricity, it is easily attracted by the negative electrode 30 via electric discharge effect on tip points of the needles 141 and easily drop from the evaporator 14 to the electrode 30 and drain away.

In conclusion, the water removal enhancement device according to the present invention rapidly removes condensed water from the evaporator, and prevent the evaporator from being hindered by water in the airflow passages. Therefore, it assures the airflow rate, lower the load of the fan, improve the heat transfer performance of the evaporator, and improve the operational efficiency of the refrigeration system, i.e., enhance the efficiency of an air conditioner, or improve the dehumidification performance of a dehumidifier.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water removal enhancement device applicable to an evaporator of a refrigeration system, comprising:

a plurality of needles, formed on bottom of said evaporator;

an electrode, mounted under said evaporator with a suitable gap from said plurality of needles; and a pulse power supply, electrically connected to said needles and said electrode, for generating an electric field to make condensed water formed on said evaporator and said needles attracted by said electrode via electric discharge effect on tip points of said needle, and easily drop from said evaporator to said electrode and drain away.

2. A water removal enhancement device according to claim 1 wherein said electrode is made of electrically conductive materials.

3. A water removal enhancement device according to claim 2 wherein said electrode is a metal wire.

4. A water removal enhancement device according to claim 2 wherein said electrode is a metal rod.

5. A water removal enhancement device according to claim 2 wherein said electrode is a metal plate.

6. A water removal enhancement device according to claim 1 wherein said pulse power supply generates a high voltage, low current electric field.

7. A water removal enhancement device according to claim 6 wherein said pulse power supply charges said electrode with positive electricity, and said evaporator and needles with negative electricity.

8. A water removal enhancement device according to claim 7 wherein said pulse power supply includes a flyback transformer.

9. A water removal enhancement device according to claim 6 wherein said pulse power supply charges said electrode with negative electricity, and said evaporator and needles with positive electricity.

10. A water removal enhancement device according to claim 9 wherein said pulse power supply includes a flyback transformer.

11. A refrigeration system comprising a compressor, a condenser, an expansion valve and an evaporator, wherein an improvement for enhancing water removal from said evaporator, comprising:

a plurality of needles, formed on bottom of said evaporator;

an electrode, mounted under said evaporator with a suitable gap from said plurality of needles; and a pulse power supply, electrically connected to said needles and said electrode, for generating an electric field to make condensed water formed on said evaporator and said needles attracted by said electrode via electric discharge effect on tip points of said needles, and easily drop from said evaporator to said electrode and drain away.

12. A refrigeration system according to claim 11 wherein said electrode is made of electrically conductive materials.

13. A refrigeration system according to claim 12 wherein said electrode is a metal wire.

14. A refrigeration system according to claim 12 wherein said electrode is a metal rod.

15. A refrigeration system according to claim 12 wherein said electrode is a metal plate.

16. A refrigeration system according to claim 11 wherein said pulse power supply generates a high voltage, low current electric field.

17. A refrigeration system according to claim 16 wherein said pulse power supply charges said electrode with positive electricity, and said evaporator and needles with negative electricity.

18. A refrigeration system according to claim 17 wherein said pulse power supply includes a flyback transformer.

19. A refrigeration system according to claim 16 wherein said pulse power supply charges said electrode with negative electricity, and said evaporator and needles with positive electricity.

20. A refrigeration system according to claim 19 wherein said pulse power supply includes a flyback transformer.

* * * * *